US006649818B2

(12) United States Patent
Bailey

(10) Patent No.: US 6,649,818 B2
(45) Date of Patent: Nov. 18, 2003

(54) MULTIPLE NECK, INTEGRAL BODY MUSICAL INSTRUMENT

(76) Inventor: Ronald Irvin Bailey, 7030-C S. Lewis Ave., P.O. Box 523, Tulsa, OK (US) 74136-3927

( * ) Notice: Subject to any disclaimer, the term of this patent is extended or adjusted under 35 U.S.C. 154(b) by 0 days.

(21) Appl. No.: 10/082,945

(22) Filed: Feb. 26, 2002

(65) Prior Publication Data

US 2003/0159562 A1 Aug. 28, 2003

(51) Int. Cl.[7] ..... G10D 3/00
(52) U.S. Cl. ..... 84/293
(58) Field of Search ..... 84/293, 291, 267, 84/263

(56) References Cited

U.S. PATENT DOCUMENTS

| | | | | | |
|---|---|---|---|---|---|
| 832,157 | A | | 10/1906 | Platts | |
| 3,130,625 | A | * | 4/1964 | Savona | 84/267 |
| 3,636,809 | A | | 1/1972 | Ezaki | |
| D224,841 | S | | 9/1972 | Dawson | |
| 4,240,319 | A | | 12/1980 | Soupios | |
| 4,250,791 | A | * | 2/1981 | Tairadate | 84/385 R |
| 4,343,217 | A | | 8/1982 | Brody | |
| 4,483,233 | A | * | 11/1984 | Benson | 84/263 |
| D279,195 | S | | 6/1985 | Perkins | |
| 4,785,705 | A | | 11/1988 | Patterson | |
| D310,090 | S | | 8/1990 | Stone et al. | |
| 4,953,434 | A | | 9/1990 | Guss | |
| 4,987,815 | A | | 1/1991 | Shockley | |
| 5,212,329 | A | | 5/1993 | Woodworth | |
| 5,315,910 | A | | 5/1994 | Soupios | |
| 5,571,980 | A | | 11/1996 | Busley | |
| 6,191,350 | B1 | * | 2/2001 | Okulov et al. | 84/646 |

* cited by examiner

*Primary Examiner*—Shih-Yung Hsieh
(74) *Attorney, Agent, or Firm*—Frank J. Catalano

(57) ABSTRACT

A multiple neck, integral single-body musical instrument having the performance of a multiple full bodied instrument but the feel of a single body construction where the body is substantially u-shaped which defines substantially parallel planes and where a neck extends from each substantially parallel plane. The musical instrument may be acoustic or electric or a combination instrument. The instrument may be a guitar, mandolin, banjo, violin, bass, fingerboard, keyboards and the like.

5 Claims, 5 Drawing Sheets

MULTIPLE NECK, INTEGRAL BODY MUSICAL INSTRUMENT

BACKGROUND OF THE INVENTION

1. Field of the Invention

This invention relates to a multiple neck, integral body musical instrument, more particularly, this invention relates to a multiple neck, integral body musical instrument that can utilize composite instrument technology, and even more particularly, this instrument relates to a multiple neck, integral body musical instrument such as a guitar, mandolin, banjo, violin, bass, fingerboard, keyboard and the like utilizing composite instrument technology.

2. Description of the Prior Art

It has been desirable to have versatility in musical instruments by utilizing a composite musical instrument so that two or more instruments such as guitars, mandolins, banjo's, violins, basses, fingerboards, keyboards and the like are configured into one. Acoustical instruments as well as electrical instruments alike can take advantage of composite instrument technology that makes it easy for musical instruments having a neck and body to be conveniently combined into one. This enables the performer the convenience of switching from one instrument to the other without placing one instrument down and picking up another. Various multiple neck instruments with a single or multiple bodies have been introduced such as acoustical guitars, electric guitars, a combination of an acoustical and an electrical guitar, multiple fingerboards, a combination of a bass guitar and lead guitar, multiple of various acoustical instruments and a multiple of various electrical instruments. Fingerboards include midi controllers, synthesizers and the like to produce the sound of the various instruments and other sounds.

These multiple neck instruments have various forms and shapes such as U.S. Pat. No. 5,315,910 issued to Soupios which discloses an external system that connects an electric guitar module to a standard guitar. In some cases these instruments can be played alternately or together. For example U.S. Pat. No. 4,240,319 issued to Soupios discloses a double neck string instrument adapted for two voice play where one neck extends parallel to the other neck, spaced apart from each other, offset longitudinally from each other, and offset from the plane of the stringed face of each neck, so that each hand can play on a different neck without interfering with the other. Similarly, U.S. Pat. No. 5,571,980 issued to Busley discloses multiple single fingerboard instruments structures linked together to dimensionally position the fingerboards horizontally, vertically and angularly relative to each other as a means for providing the player with the most beneficial structural configuration for simultaneous engagement by the hands on separate fingerboards. Also combination guitars have been disclosed such as U.S. Patent issued to Shockley discloses a guitar with a full acoustical hollow body with a standard neck combined with a solid electrical guitar with a second neck and a body structurally attached to the side wall of the acoustical hollow body. Even a much older U.S. Pat. No. 832,157 issued to Platts discloses a mandolin attachment for a guitar.

Various other forms have been utilized to take advantage of having multiple neck musical instruments such as U.S. Pat. No. 3,636,809 issued to Ezaki. In this instrument, musical tones having a variety of tone colors can be produced on both sides of the sound box by having two necks and two sound boards having its back opposite each other on opposite sides of the sound box. Strings are strung on each neck over a sound hole on the opposing sides of the sound box. Even another design, U.S. Pat. No. 5,212,329, provides an electric guitar mounted with straps upon an acoustic guitar. U.S. Pat. No. 4,785,705 straps two electric guitars together with straps. Yet another, U.S. Pat. No. 4,343,217, has two complete sets of strings, amplification pickups, volume and tone controls and necks which radiate in substantially opposite directions. This instrument is rotated by the performer on a horizontal axis to bring the instrument into the desired playing position.

While these multiple neck musical instruments have the convenience of composite instrument technologies which yields versatility available to a performer, these instruments lack the feel of a single neck instrument and are either too heavy, not balanced, have a lack of comfort in playing on one neck as with playing on the other. Further these instruments lack a handsome, futuristic and ergonomic design. It is therefore desired to have a multi-neck musical instrument that has the feel of a single neck instrument and can utilize the convenience of combined instrument technology, one which is balanced, have the ergonomics of playing all multiple necks comfortably, and having a handsome, futuristic design.

SUMMARY OF THE INVENTION

Accordingly, applicant has invented a multiple neck single integral body musical instrument having the performance of multiple full bodied instruments but the feel of single body construction. The body of the instrument is substantially u-shaped defining substantially parallel planes. A neck extends from each defined plane. The instrument may have keys, strings or fingerboard. It may be played with a bow or fingers. The musical instrument may be acoustic, semi-acoustic or electric or a combination instrument. The instrument may be a guitar, mandolin, banjo, violin, bass, fingerboard, keyboard and the like.

DESCRIPTION OF THE PREFERRED EMBODIMENTS

Figure 3:
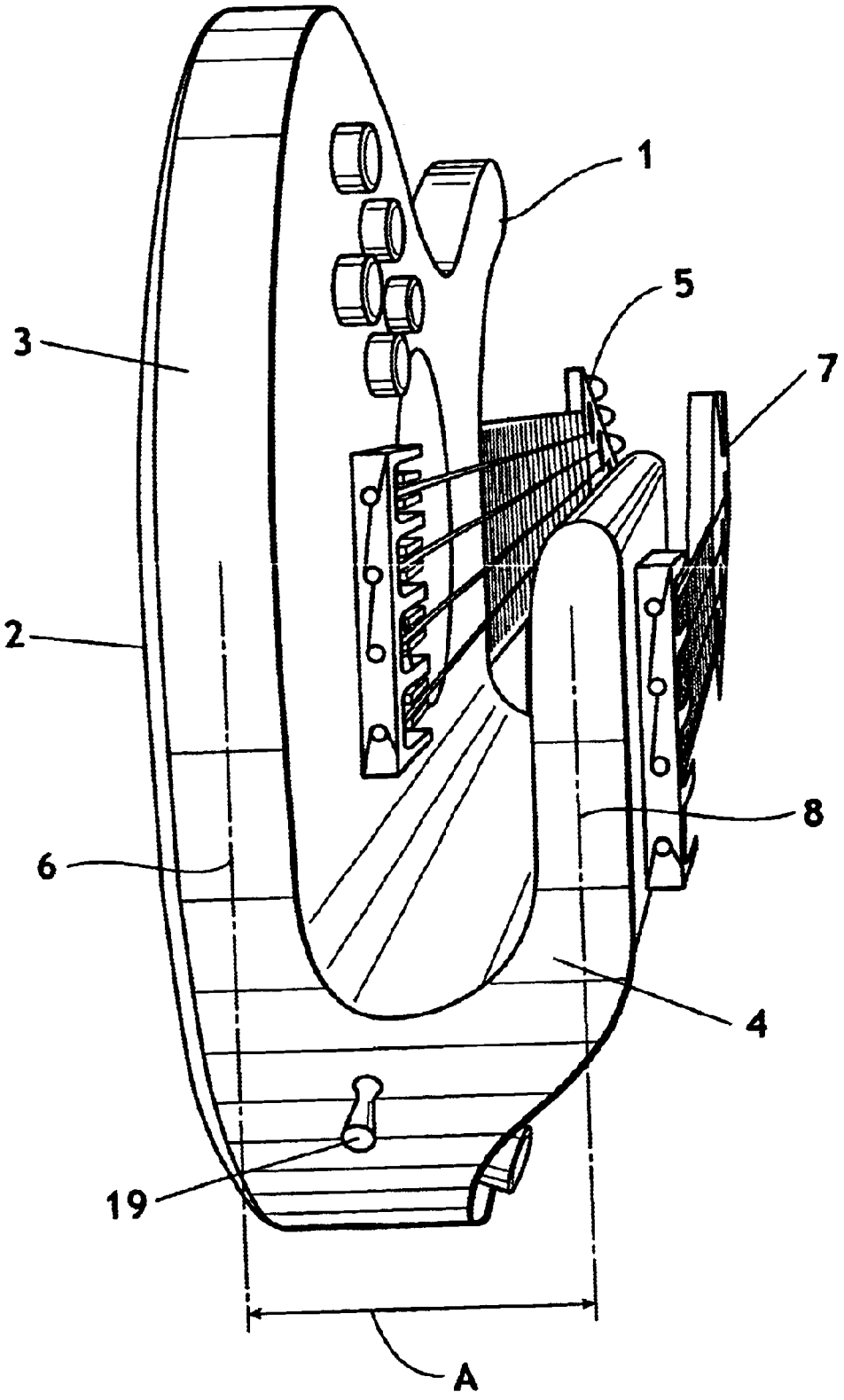
FIG. 3 is a posterior end perspective view of a composite base guitar according to an embodiment of applicant's musical instrument.

A preferred embodiment of the invention comprises an assembly as depicted in FIG. 3 which shows the substantially u-shape of the body of the instrument. By u-shape, it is meant that there are two planes defined by one integral body, whereby the two planes are connected by the substantial u-shape. It should be understood that upwardly extending members of the u-shaped body need not be of equal height and that one of the upwardly extending members on the base may be extended downwardly. Thus, "u-shape" include a y-shape such as in FIG. 3 and a j-shape such as in FIG. 5. The "u" may be substantially rounded or substantially squared. Reference is now made to FIG. 3 which shows a composite bass guitar 1 having space "A" between the plane 6 which defines sound box 3 and plane 8 which defines soundboard 4. In this embodiment is a bass guitar 1 defined by two necks, 5 and 7, and body 2. The four-stringed neck 5 radiates from soundbox 3 and the four-stringed neck 7 radiates from soundboard 4. The necks 5 and 7 are substantially parallel to the planes 6 and 8 are substantially parallel. Strap hook 19 is shown also.

Figure 2:
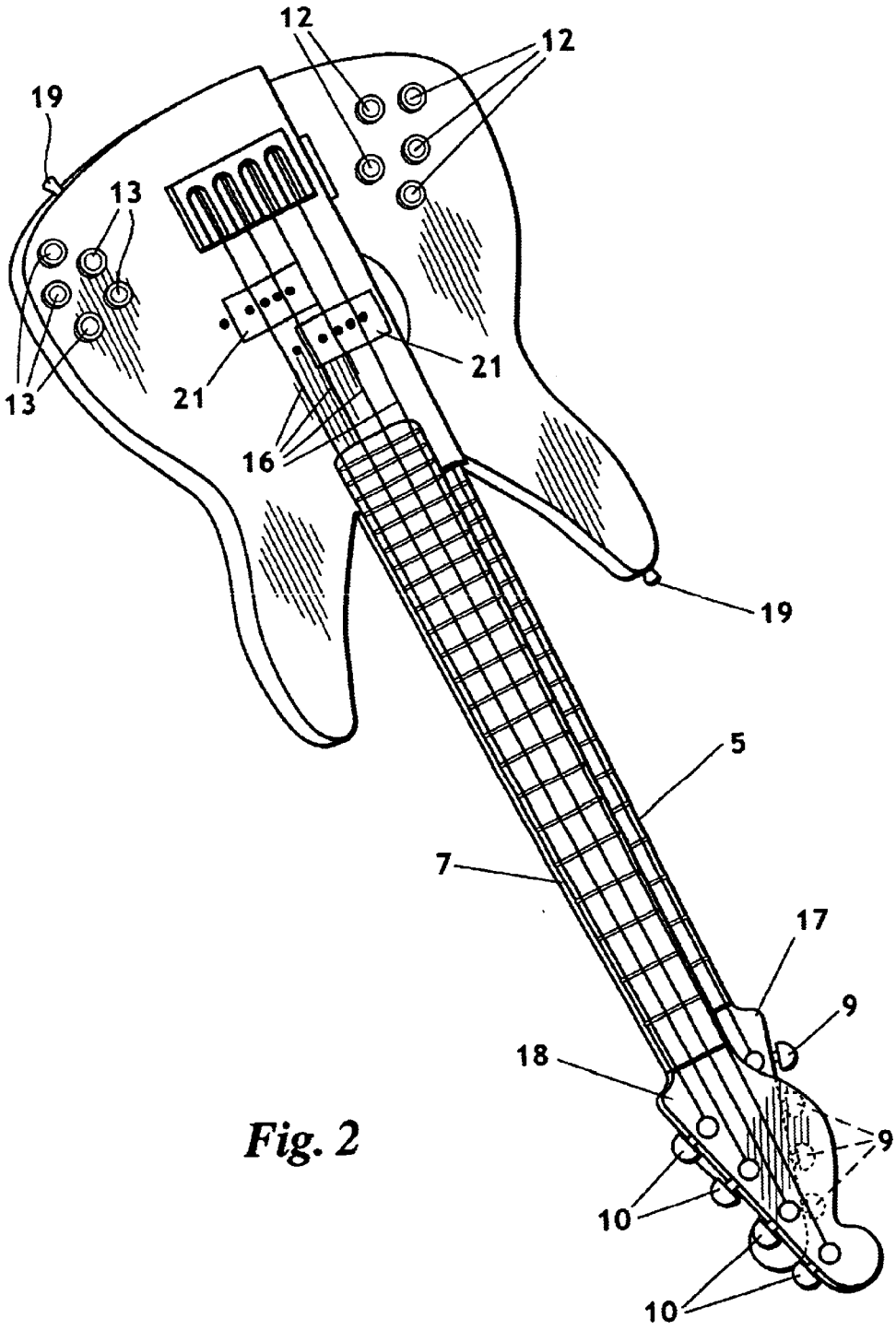
FIG. 2 is a plan perspective view of a composite base guitar according to an embodiment of applicant's musical instrument.

Reference is now made to FIG. 2 witch shows a composite bass 1 with the tuners 9 on headstock 17 for the four strings 15 on neck 5 (not shown in this view, see FIG. 4) and tuners 10 on headstock 18 for the four strings 16 on neck 7. These are configured by means well known by those of ordinary skill in the art. Also shown are the electronic control means 12 for strings 15 and control means 13 for strings 16 (not seen in this view, see FIG. 4) for which usually include volume control, tone control and pickup switch. Dual pickups 21 are mounted beneath strings 16 as well known in the art. It can be seen from this view of this embodiment of the invention that the musical instrument looks like a single neck instrument. This view also illustrates that this instrument has the balance and feel of a single neck instrument.

Figure 4:
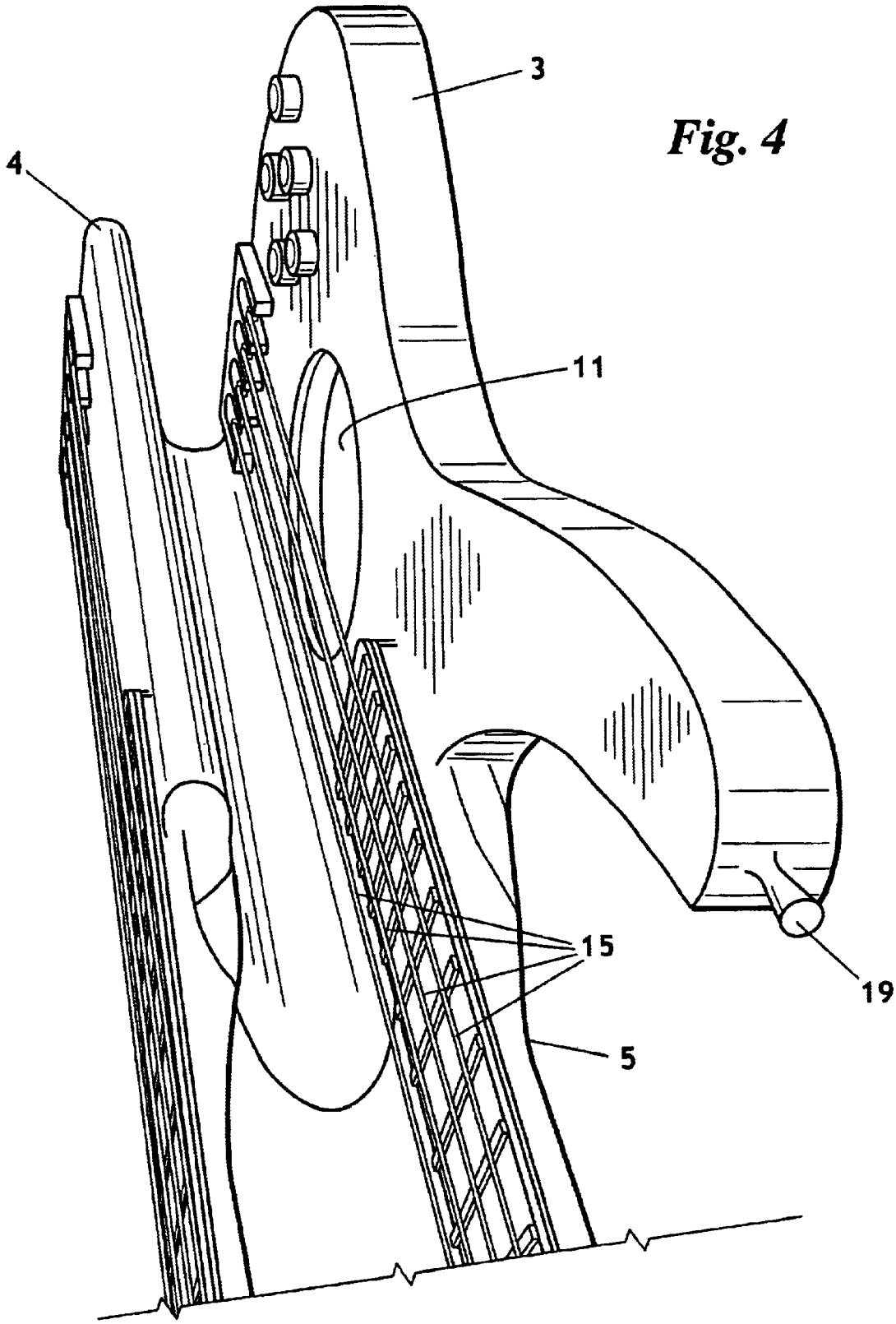
FIG. 4 is a close-up side view of a composite bass guitar according to an embodiment of applicant's musical instrument.

Reference is now made to FIG. 4 which depicts the space between soundbox 3 and soundboard 4. Strings 15 for neck 5 is clearly shown. It can be seen that the fingers can reach between the soundboard and soundbox. It should be noted that the necks can be offset relative to each other to the extent needed for the hand to reach comfortably between soundbbox 3 and soundboard 4. It should be readily seen that the soundbox 3 could be solid or semi-acoustic and soundboard 4 can be acoustic or semi-acoustic. By acoustic it is meant without amplification, by semi-acoustic it is meant acoustic with electronic amplification and by solid it is meant with electronic amplification only. Therefore, when it is a soundbox and acoustic, it can be with or without electronic amplification. In this embodiment the soundboard 4 is solid and soundbox 3 is hollow for semi-acoustic effect with hole 11 as shown in soundbox 3.

Figure 1:
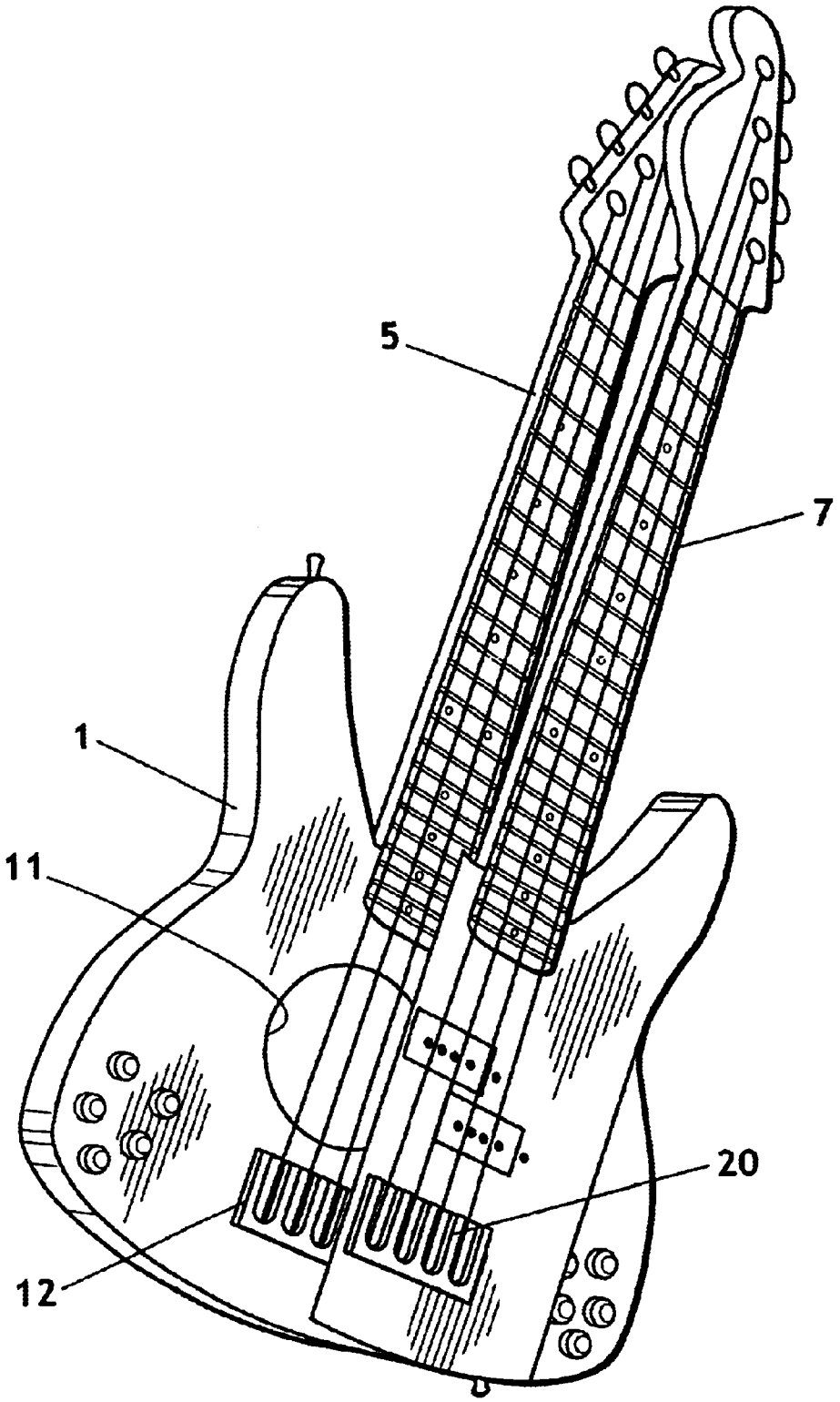
FIG. 1 is a three dimensional perspective view of a composite bass guitar according to an embodiment of applicant's musical instrument.
Figure 5:
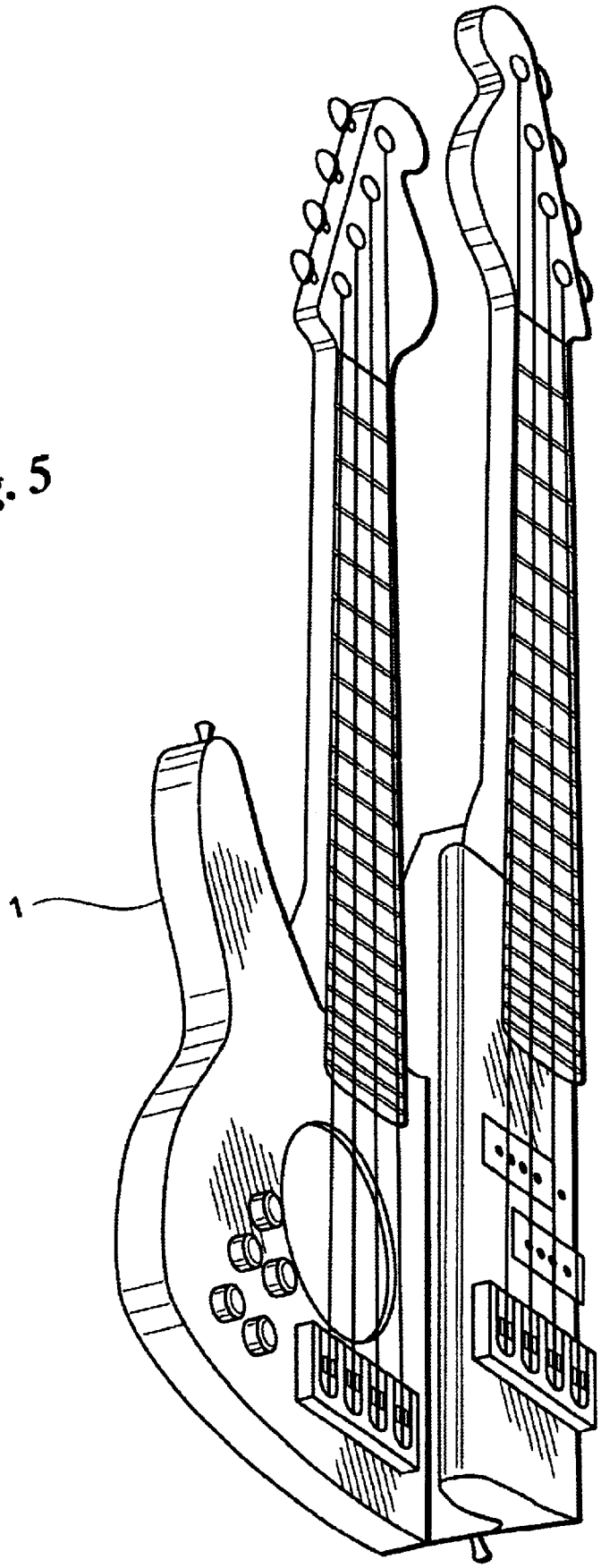
FIG. 5 is a side view of a composite base guitar according to an embodiment of applicant's musical instrument.

Reference is now made to FIG. 1, which shows composite bass guitar 1 having hole 11 for semi-acoustic effect. Also shown are string anchor and bridge 12 for neck 5 and neck 7. FIG. 5 shows the look of the bass 1 from the inside of the "u" shape. The integral body is very well depicted in this view.

Reference is now made to FIG. 5, which shows composite bass guitar 1 from an angle which shows the inside of the u-shape. This instrument is strung and electronically configured by means of those ordinarily skilled in the art of making musical instruments. It will be readily understood that different materials can be used to construct this instrument as are available such as woods, lightweight metal, laminates, plastic, composites of various materials and the like which are all suitable for use in constructing the above described invention. It is also readily understood that many different combinations of musical instruments can be made with applicant's invention. Modifications may be made without departing from applicant's inventive concept. For example, a two or more piece body can by secured together to give the effect and appearance and ergonomics of an integral body. Guitars, mandolins, banjos, violins, basses, fingerboard, keyboards and the like can be configured using applicant's inventive concept. Therefore the present embodiment is an illustration and not a restriction of applicant's invention.

What I claim is:

1. A multiple neck musical instrument comprising a body of U-shaped cross-section having substantially parallel spaced apart sound members with front playing surfaces extending upwardly from a substantially transverse base and a pair of necks, one extending longitudinally from each sound member, each said neck having a front playing surface substantially parallel to said sound member playing surfaces.

2. The musical instrument of claim 1, wherein the musical instrument is a string instrument.

3. The musical instrument of claim 1, wherein the musical instrument is a combination guitar.

4. The musical instrument of claim 1, wherein the musical instrument is a combination bass.

5. The musical instrument of claim 1, wherein the musical instrument is a combination of a base and a guitar.

* * * * *